US010675638B2

(12) United States Patent
Butler

(10) Patent No.: US 10,675,638 B2
(45) Date of Patent: Jun. 9, 2020

(54) NON CONTACT MAGNETIC SEPARATOR SYSTEM

(71) Applicant: MAGNETIC SYSTEMS INTERNATIONAL, Boyne City, MI (US)

(72) Inventor: Darren Paul Butler, Mancelona, MI (US)

(73) Assignee: MAGNETIC SYSTEMS INTERNATIONAL, Boyne City, MI (US)

( * ) Notice: Subject to any disclaimer, the term of this patent is extended or adjusted under 35 U.S.C. 154(b) by 0 days.

(21) Appl. No.: 15/711,269

(22) Filed: Sep. 21, 2017

(65) Prior Publication Data

US 2018/0078946 A1 Mar. 22, 2018

Related U.S. Application Data

(60) Provisional application No. 62/397,658, filed on Sep. 21, 2016.

(51) Int. Cl.

| | |
|---|---|
| ***B03C 1/247*** | (2006.01) |
| ***B03C 1/033*** | (2006.01) |
| ***B03C 1/12*** | (2006.01) |
| ***B03C 1/26*** | (2006.01) |

(52) U.S. Cl.

CPC ..... *B03C 1/247* (2013.01); *B03C 1/0332* (2013.01); *B03C 1/12* (2013.01); *B03C 1/26* (2013.01); *B03C 2201/20* (2013.01)

(58) Field of Classification Search

CPC .. B03C 1/12; B03C 1/247; B03C 1/26; B03C 1/0332; B03C 2201/20

See application file for complete search history.

(56) References Cited

U.S. PATENT DOCUMENTS

| | | | | |
|---|---|---|---|---|
| 2,939,580 | A * | 6/1960 | Carpenter | B03C 1/12 209/2 |
| 6,318,558 | B1 * | 11/2001 | Exner | B03C 1/23 209/2 |
| 6,540,088 | B2 * | 4/2003 | Oder | B03C 1/02 209/128 |
| 7,210,581 | B2 * | 5/2007 | Robinson | B03C 1/00 209/221 |
| 7,296,687 | B2 * | 11/2007 | Arvidson | B03C 1/18 209/218 |

(Continued)

*Primary Examiner* — Charles A Fox
*Assistant Examiner* — Kalyanavenkateshware Kumar
(74) *Attorney, Agent, or Firm* — Dinsmore & Shohl LLP

(57) ABSTRACT

A magnetic separator for a product having ferrous and non-ferrous particles includes a housing having an entry section and a cleaning section. A driven magnetic roller is disposed within the cleaning section. A non-magnetic isolator including inner and outer surfaces is positioned in the cleaning section and surrounds and seals the driven magnetic roller. The driven magnetic roller is positioned proximate the inner surface of the non-magnetic isolator. The magnetic roller includes a magnetic field that penetrates a flow of product contacting the non-magnetic isolator wherein ferrous particles travel along the outer surface of the isolator and non-ferrous particles do not travel on the outer surface separating the ferrous and non-ferrous particles. The driven magnetic roller has no direct contact with the product.

18 Claims, 4 Drawing Sheets

(56) References Cited

U.S. PATENT DOCUMENTS

| | | | | |
|---|---|---|---|---|
| 7,410,573 | B2 * | 8/2008 | Saho | B03C 1/284 210/206 |
| 7,785,475 | B2 * | 8/2010 | Saho | B03C 1/0332 209/214 |
| 9,242,251 | B2 * | 1/2016 | Reaves | B03C 1/14 |
| 2005/0092656 | A1 * | 5/2005 | Yan | B03C 1/22 209/12.2 |
| 2007/0034554 | A1 * | 2/2007 | Van Der Weijden | B03B 9/04 209/213 |
| 2013/0240413 | A1 * | 9/2013 | Keaton | B03C 1/0332 209/3.1 |
| 2013/0264248 | A1 * | 10/2013 | Smolkin | B03C 1/18 209/214 |
| 2014/0339138 | A1 * | 11/2014 | Koslow | B03C 1/0332 209/3 |
| 2014/0367339 | A1 * | 12/2014 | Awadalla | B03C 1/18 210/695 |
| 2015/0076039 | A1 * | 3/2015 | Chappard | B03C 1/18 209/215 |
| 2015/0352562 | A1 * | 12/2015 | Morris | B03C 1/0332 209/214 |

* cited by examiner

NON CONTACT MAGNETIC SEPARATOR SYSTEM

CROSS-REFERENCE TO RELATED APPLICATIONS

This application claims priority of U.S. Provisional Patent Application Ser. No. 62/397,658 filed Sep. 21, 2016 which is incorporated herein by reference.

FIELD OF THE INVENTION

The invention relates to magnetic cleaning structures and separation systems.

BACKGROUND OF THE INVENTION

Magnetic separators may be utilized in bulk process industries to remove ferrous or magnetic particles from dry, free flowing product. Generally magnetic separator systems include structures in which a product is flown through a housing with a rotating drum. The product contacts a magnetic roller to remove the ferrous material. The cleaned product is then directed out of the housing and separated into ferrous and non ferrous groups.

Generally, the magnetic roller is positioned in the product flow such that it may remove material captured by the magnetic roller. However, such systems are prone to problems as the product contacts the magnetic roller and may require higher maintenance due to bearings being exposed to product. Also, since there is a mechanical rotating drum in the product flow, it is virtually impossible to sanitary grade finish the housing and drum. The rotating drum also can be dangerous if any personnel were to reach into the drum housing during operation.

There is therefore a need in the art for an improved magnetic separator that solves the problems associated with the prior art and reduces or eliminates wear on components of the system. Additionally, there is a need in the art for a magnetic separator system that does not require complicated cleaning and allows the ability to have a completely sealed system with no moving components within the product flow. This allows an extremely easy cleaning of the system. There is also a need for a sealed system without exposed moving parts allowing a cleaning process at any time during operation.

SUMMARY OF THE INVENTION

In one aspect, there is disclosed a magnetic separator for a product having ferrous and non-ferrous particles and includes a housing having an entry section and a cleaning section. A driven magnetic roller is disposed within the cleaning section. A non-magnetic isolator including inner and outer surfaces is positioned in the cleaning section and surrounds and seals the driven magnetic roller. The driven magnetic roller is positioned proximate the inner surface of the non-magnetic isolator. The magnetic roller includes a magnetic field that penetrates a flow of product contacting the non-magnetic isolator wherein ferrous particles travel along the outer surface of the isolator and non-ferrous particles do not travel on the outer surface separating the ferrous and non-ferrous particles. The driven magnetic roller has no direct contact with the product.

In another aspect, there is disclosed a magnetic separator for a product having ferrous and non-ferrous particles and includes a housing having an entry section and a cleaning section. A driven magnetic roller is disposed within the cleaning section. A non-magnetic isolator including inner and outer surfaces is positioned in the cleaning section and surrounds and seals the driven magnetic roller. The non-magnetic isolator includes a curved body having an upper angled portion coupled to a lower tapered portion by a curved surface that accommodates the driven magnetic roller. The upper angled portion is angled such that it has a steeper angle than an angle of repose of an incoming product. The driven magnetic roller is positioned proximate the inner surface of the non-magnetic isolator. The magnetic roller includes a magnetic field that penetrates a flow of product contacting the non-magnetic isolator wherein ferrous particles travel along the outer surface of the isolator and non-ferrous particles do not travel on the outer surface separating the ferrous and non-ferrous particles. The driven magnetic roller has no direct contact with the product.

In a further aspect, there is disclosed a magnetic separator for a product having ferrous and non-ferrous particles and includes a housing having an entry section and a cleaning section. The entry section includes a baffle positioned therein, the baffle controls an angle of entry of the product wherein the angle of entry is from zero to 45 degrees as measured from a vertical plane. A driven magnetic roller is disposed within the cleaning section. A non-magnetic isolator including inner and outer surfaces is positioned in the cleaning section and surrounds and seals the driven magnetic roller. The driven magnetic roller is positioned proximate the inner surface of the non-magnetic isolator. The magnetic roller includes a magnetic field that penetrates a flow of product contacting the non-magnetic isolator wherein ferrous particles travel along the outer surface of the isolator and non-ferrous particles do not travel on the outer surface separating the ferrous and non-ferrous particles. The driven magnetic roller has no direct contact with the product.

DETAILED DESCRIPTION OF THE PREFERRED EMBODIMENTS

Figure 1:
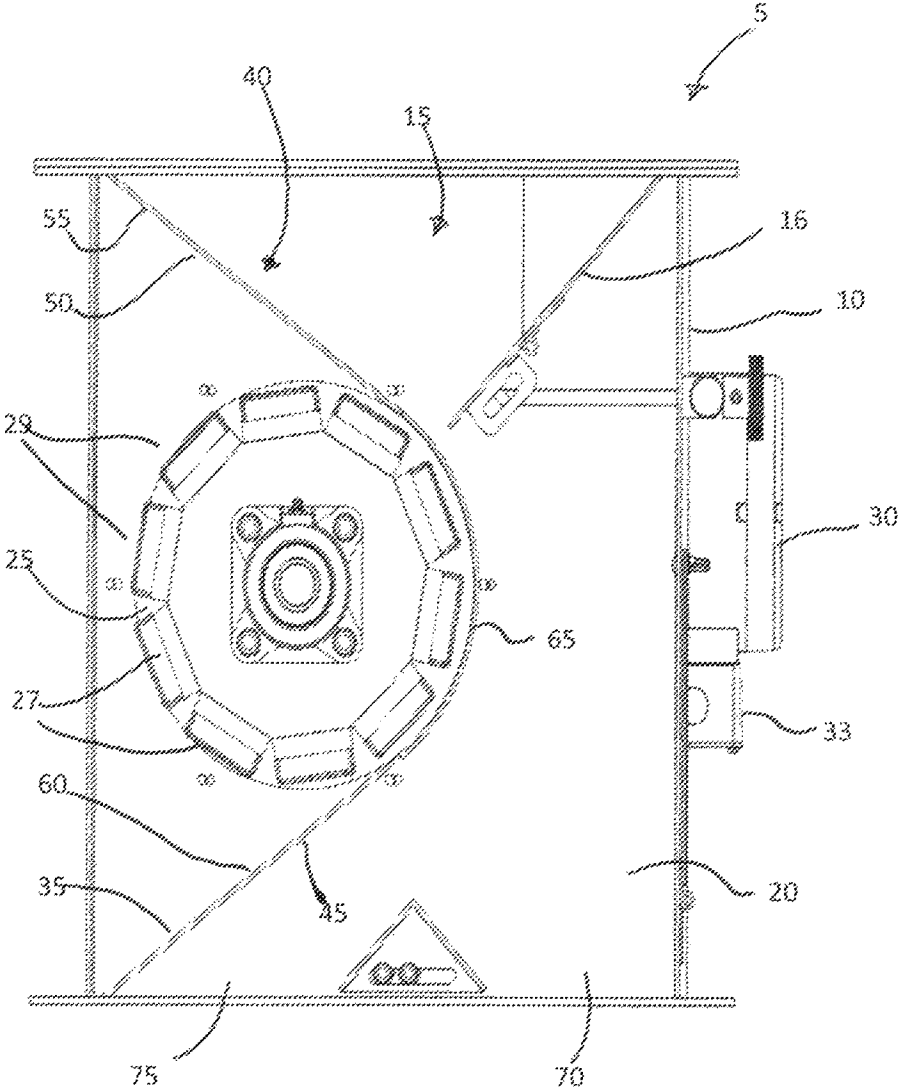
FIG. 1 is a side sectional view detailing a magnetic separator system including a 12 pole magnetic roller.

Referring to FIGS. 1-4, there are shown embodiments of a magnetic separator system 5. The magnetic separator system 5 includes a housing 10. The housing 10 may include various sections and be in the form of a chute which has an opening on top, and a diverter on the bottom to distribute the separated material. In the depicted embodiment, the housing 10 includes an entry section 15 into which contaminated product is delivered to a separated or cleaning section 20. The entry section 15 may include a baffle 16 that controls the angle at which a product is introduced into the separator as will be discussed in more detail below.

A magnetic roller 25 is disposed within the housing 10 within the cleaning section 20. The magnetic roller 25 may be driven by a motor 30 which may include a reduction transmission 33. In one aspect, the motor 30 may be electrically driven, although other types of motors may be utilized.

In one aspect, the driven magnetic roller 25 is journaled or rotatably retained within the cleaning section 20 utilizing appropriate bearings or other types of structures. The magnetic roller 25 is coupled to the motor 30 to be driven rotatably. In one aspect, the magnetic roller 25 may include rare earth magnets or other types of magnets 27 such as ceramic magnets in a pattern to remove ferrous particles from the product.

In one aspect, the magnetic roller 25 is surrounded by a nonmagnetic isolator 35 that is welded or otherwise attached to the housing 10 and completely seals the magnetic roller 25 from the product. The isolator 35 may be formed of various materials including stainless steel. The isolator 35 includes a curved body 40 having outer and inner surfaces 45, 50. The curved body 40 includes an upper angled portion 55 coupled to a lower tapered portion 60 by a curved surface 65 that accommodates the magnetic roller 25. The magnetic roller 25 is positioned proximate the inner surface 50 of the isolator 35 and includes a magnetic field that penetrates the flow of the product but is completely isolated from product contact.

The upper angled portion 55 may be angled such that it has a steeper angle than the angle of repose of the incoming product. In one aspect the angle may be from 30 to 60 degrees as measured from a horizontal plane, but may outside such a range for various systems such as in various forcibly fed systems.

The lower tapered portion 60 has an angle such that the curved body moves away from the magnetic roller 25 and outside of the magnetic field of the magnetic roller 25. Various factors may influence the degree of the angle of the lower tapered portion 60 for various applications. For example, the rotational speed of the magnetic roller 25, the type of magnets and pattern of the magnets and the packaging size of the housing 10 may all affect the shape of the lower tapered portion 60. It should be realized that various tapered shapes may be utilized that allows for ferrous particles to be moved outside the magnetic field of the roller 25.

In use, a dry, free flowing product enters the system through the product entry point 15. The contaminated product contacts the upper angled portion 55 of the isolator 35 that is positioned in the cleaning section. As the contaminated product passes over upper angled portion 55 the magnetic roller 25 attracts ferrous particles to the outer surface 45 of the isolator 35. The magnetic roller 25 may be continuously rotating in a clockwise direction as shown in the figure at a predetermined rate. Rotation of the magnetic roller 25 causes the ferrous particles in the product to be removed from the product and travel along the outer surface 45 of the isolator 35.

As the magnetic roller 25 rotates, the magnetic particles are held to the outer surface 45 of the isolator 35 and the cleaned product is discharged to the exit 70. The magnetic particles are attracted to the magnetic roller 25 and the magnetic force holds the contaminants to the outside of the isolator 35. As the magnetic roller 25 rotates, the ferrous particles also move in a clockwise direction as shown in FIG. 1. In one aspect, to impart motion to the ferrous particles a magnetic differential may be utilized. The magnetic differential may be accomplished with a dead zone, a multi-pole design, a strong zone, or a combination of these designs. In one aspect, a variance in the magnetic field of the roller or magnets in specified locations may pull the ferrous particles in a desired direction as the relatively stronger magnetic field sections proportionally attract the ferrous particles to a greater extent than the relatively weaker sections. As the magnetic particles reaches the lower tapered portion 60, the magnetic particles move outside the magnetic field of the magnetic roller 25 and fall into a ferrous side of the exit chute 75. In one aspect, the continuous movement of the roller 25 provides an automated process in which magnetic particles are removed from the product continuously. The nonmagnetic isolator 35 completely seals the magnetic roller 25 from the product minimizing wear and allowing simplified cleaning of the system. The cleaning process may be as simple a wiping down the outer surface 45 of the isolator 35. The system may be used in various applications such as in food grade, pharmaceutical, hazardous and dusty environments.

While the above description discloses a free flowing dry system, the magnetic separator system 5 may also be utilized in other material handling systems such as pneumatic or hydraulic systems. A traditional drum separator contributes to the flow of the material through the rotation of the drum/wipers which are in direct contact with the burden or product. The structure of the present application of a no-contact separator, on the other hand, is generally not contributing to the flow of non-ferrous burden; therefore, any burden in motion that does not require the separator to cause the motion would be viable for separation.

Various magnetic configurations may be utilized to achieve desired results for different applications, such as: 1) compact magnetic circuit. 2) deep-reaching magnetic circuit, 3) single pole, 4) multi-pole, 5) axial orientation, 6) radial orientation, 7) Halbach array, 8) different magnetic materials (neodymium iron boron, samarium cobalt, alnico, ceramic, electromagnetic, etc.), 9) different amounts of magnetic coverage from 0 to 360 degrees (preferably from 270 to 330), 10) different diameters of the magnets or roller, 11) different widths of the magnets or roller, 12) different widths of coverage, 13) combinations of different magnet strengths/types, 14) different rotational speeds (preferably such that the magnetic field is traveling at a higher speed than the flow of burden at the magnetic contact area or even variable speed for in field adjustments), 15) multiple-stage designs, with similar or different configurations at each stage for the targeted capture of different ferrous materials, 16) different spacing/orientation of the internal magnetic element relative to the outer working surface which may be adjusted.

As provided above, different materials of construction can be used for the isolator 35. In additional to the actual composition, different frictional surfaces may also be utilized. In one aspect, lower frictional surfaces may be desirable for some applications, while in other applications higher frictional surfaces are a benefit. The coefficient of friction of the outer surface may be selected to slow movement on the outer surface or promote movement on the outer surface. Various surface coatings or structures such as grooves, abrasions or roughness may be selected to change the coefficient of friction. The higher the friction of the isolator surface, the greater the disparity of the velocity of the ferrous to the non-ferrous particles. Such a disparity may have a benefit for the separation of dusty applications with smaller particles that would otherwise have static cling. Once the ferrous material is captured, it primarily will stay on the magnetic surface until it reaches the tapered section 60 and falls out of the magnetic field. The longer that transit takes from the point of capture to the tapered section 60 of the isolator 35, the more opportunity there is for non-ferrous to separate from the ferrous particles such as in dusty applications where there's some bonding of the particles to one another. In an axial arrangement, the ferrous material will be agitated as it's magnetized from north to south. The agitation further provides separation when clingy non-ferrous material is present. Therefore, a higher friction surface will slow the separation and increase the agitation when that would be desirable. Likewise, a lower friction surface would allow for a quicker separation but would not provide for as much of the agitation.

In one aspect, the rotation of the roller may be with the flow of gravity in a gravity fed environment; however, there are instances where the roller could be rotating against gravity in a gravity fed environment or against gravity in a pneumatic or hydraulic environment or inline completely ignoring the direction of gravity altogether.

For materials that don't easily drop off from the tapered section, an assist could be used. This assist could take any number of forms such as: 1) physical wiper, 2) magnetic trap (allowing the ferrous material to jump from the isolator to the trap), 3) blower, 4) vibrator, 5) water jet, etc.

In one aspect, the magnets 27 and roller 25 may also induce eddy currents which can throw non-ferrous metals such as aluminum and copper at a different trajectory than either the flow of burden or the captured ferrous material. The non-ferrous conductive metals may be affected by the magnetic field such that they are thrown away from or repelled from the isolator while ferrous material is captured on the isolator and the burden follows a normal trajectory.

EXAMPLES

Testing was performed on various materials utilizing a 12 pole magnet and 4 pole magnet roller 25 as will be described in the following examples.

Example 1

Figure 3:
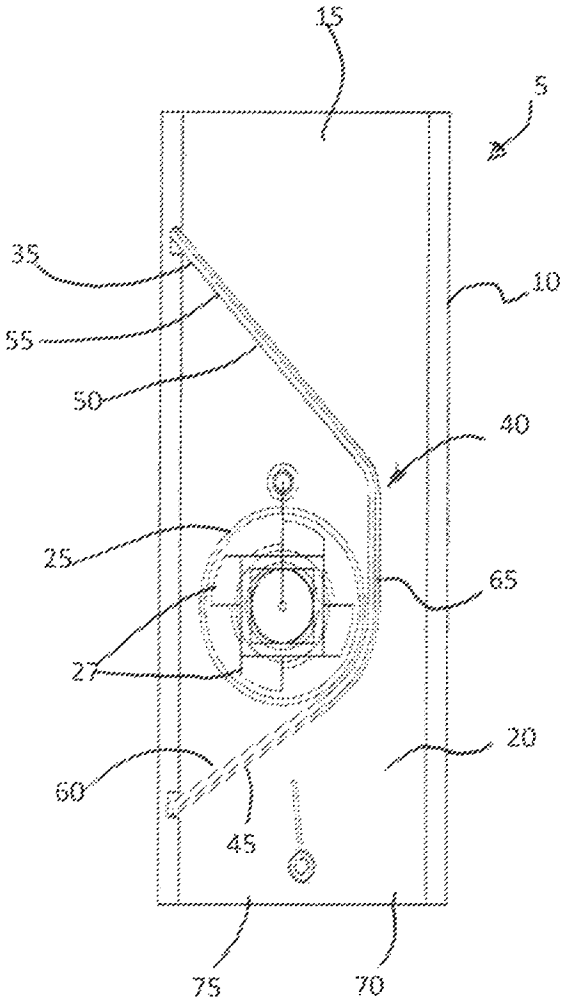
FIG. 3 is a side sectional view detailing a magnetic separator system including a 4 pole magnetic roller.

A sand mixture containing both silica sand and magnetic black sand (actually magnetite particles) was provided to a 4 pole magnetic separator as shown in FIG. 3. This is a common application found in gold mining and gas fracking applications. In both cases it is desirable to remove the ferrous black sand from the silica sand. The separation was performed with a smaller magnetic element of only about 2.5 inches in diameter and included 4 same-pole magnets which include a radius on them providing an improved fit within the isolator. The magnetic field of one of the 4 poles was dampened so as to more easily allow the discharge of ferrous once per revolution.

Figure 2:
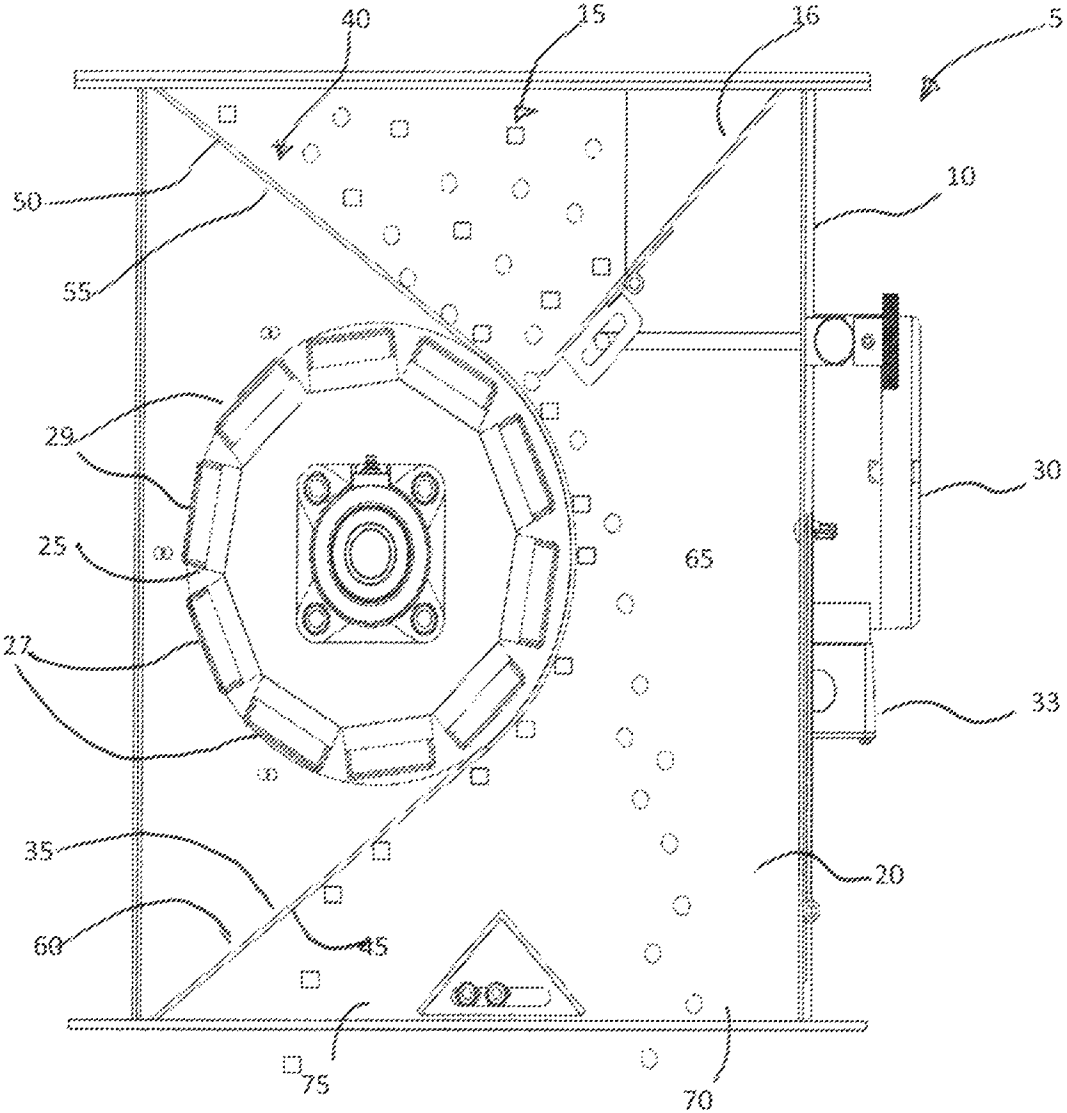
FIG. 2 is a side sectional view detailing a magnetic separator system including a 12 pole magnetic roller showing a separation of differing media.
Figure 4:
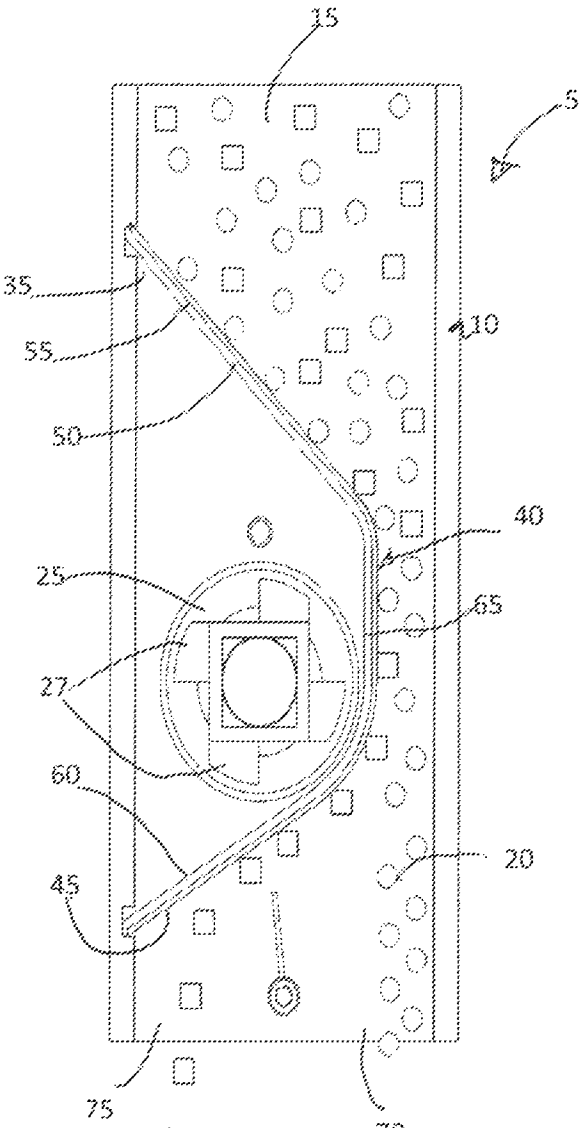
FIG. 4 is a side sectional view detailing a magnetic separator system including a 4 pole magnetic roller showing a separation of differing media.

Additionally as shown in FIG. 4, the entry of the burden was moved from a 45 degree decent with the baffle 16 as shown in FIG. 2 to a straight 90 degree vertical drop with no baffle 16 in order to ensure that the sand was in a state of freefall as it entered the magnetic pickup zone.

This freefall feature was added after testing and observation concluded that ferrous was clumping together with the silica sand as the sand entered the pickup zone when introduced at a 45 degree angle causing unwanted carry-over of the silica sand into the ferrous discharge.

With the vertical drop, however, there was almost no silica carry over and the magnets were still strong enough to pull out the same amount of ferrous. Testing demonstrated 87% recovery of ferrous in a single pass with an approximately 47% ferrous content in the feed mix. A rotational speed of about 200 rpm was utilized such that the magnetic elements were moving faster than the sand was falling preventing ferrous from building up on the isolator.

Example 2

Testing was also performed with a mixture of plastic and steel ball media. Magnetic separation is aided by ferrous objects with elongated shapes and high surface to volume ratios; therefore, steel ball bearings are well known in the magnetic separation industry to be much more difficult to separate than other ferrous objects such as nails or bolts. A separator with a 12-pole design with 2 poles being removed to provide a dead zone 29 where the captured ferrous could be discharged as depicted in FIGS. 1 and 2 was utilized. The diameter of the magnetic roller was approximately 10 inches and a speed of about 80-rpm was utilized. When a 10:1 ratio of non-ferrous to ferrous was introduced into the separator, there was 100% recovery of the steel ball media. When the amount of ferrous was increased to 3:1 non-ferrous to ferrous, a recovery of 98% of the ferrous was achieved. In one aspect, a larger diameter roller may be utilized to handle higher ferrous loads.

Testing has demonstrated that different mixtures may benefit from various magnetic configurations, but a same pole magnet configuration and a single weak zone or dead zone positioned on the roller to allow for drop off has provided very high recovery. Generally, the more slippery the material (such as ball media which moves very freely), the greater the benefit there has been with a less aggressive incline into the separator, such as 45 degrees. For materials that tend to agglomerate an aggressive incline right up to a vertical drop may be utilized so as to put the material to be separated in a state of free-fall.

In general, the best results were achieved when the face velocity of the rotating magnetic elements either matched or slightly exceeded the velocity of the incoming material. Such a rotational speed is a benefit because the magnets do not have to fight with the inertia of the ferrous nor was there a build-up of faster-moving ferrous on a slower-moving magnetic trap.

While the apparatus has been described with reference to an exemplary embodiment, it will be understood by those skilled in the art that various changes may be made and equivalents may be substituted for elements thereof without departing from the scope of the apparatus. In addition, many modifications may be made to adapt a particular situation or material to the teachings of the apparatus without departing from the essential scope thereof. Therefore, it is intended that the apparatus not be limited to the particular embodiment disclosed as the best mode contemplated for carrying out this apparatus, but that the apparatus will include all embodiments falling within the scope of the appended claims.

The invention claimed is:

1. A magnetic separator for a product having ferrous and non-ferrous particles comprising:

a housing including an entry section and a cleaning section;

a driven magnetic roller disposed within the cleaning section;

a non-magnetic isolator including inner and outer surfaces, the non-magnetic isolator positioned in the cleaning section and attached to the housing, the non-magnetic isolator surrounding and sealing the driven magnetic roller wherein the outer surface of the non-magnetic isolator includes a frictional coefficient selected to either slow movement of the ferrous particles on the outer surface or promote movement of the ferrous particles on the outer surface;

wherein the driven magnetic roller is positioned proximate the inner surface of the non-magnetic isolator and the magnetic roller includes a magnetic field that penetrates a flow of product contacting the non-magnetic isolator wherein ferrous particles travel along the outer surface of the isolator and non-ferrous particles do not travel on the outer surface separating the ferrous and non-ferrous particles without contact of the product with the driven magnetic roller.

2. The magnetic separator of claim 1 wherein the non-magnetic isolator includes a curved body having an upper angled portion coupled to a lower tapered portion by a curved surface that accommodates the driven magnetic roller.

3. The magnetic separator of claim 2 wherein the upper angled portion is angled such that it has a steeper angle than an angle of repose of the incoming product.

4. The magnetic separator of claim 3 wherein the upper angled portion is angled from 30 to 60 degrees as measured from a horizontal plane.

5. The magnetic separator of claim 2 wherein the lower tapered portion has an angle such that the curved body moves away from the magnetic roller and outside of the magnetic field of the driven magnetic roller.

6. The magnetic separator of claim 1 wherein the magnetic roller includes a magnetic differential.

7. The magnetic separator of claim 6 wherein the magnetic differential includes a dead zone of magnets having a lower magnetic field.

8. The magnetic separator of claim 1 wherein the magnets are positioned about the magnetic roller from 270 to 330 degrees of coverage.

9. The magnetic separator of claim 1 wherein the magnetic roller includes a plurality of rare earth magnets positioned thereon.

10. The magnetic separator of claim 1 wherein the magnets include a radius formed thereon matching a curvature of the non-magnetic isolator.

11. The magnetic separator of claim 1 wherein the entry section includes a baffle positioned therein, the baffle controlling an angle of entry of the product.

12. The magnetic separator of claim 11 wherein the angle of entry is from zero to 45 degrees as measured from a vertical plane.

13. A magnetic separator for a product having ferrous and non-ferrous particles comprising:

a housing including an entry section and a cleaning section;

a driven magnetic roller disposed within the cleaning section;

a non-magnetic isolator including inner and outer surfaces, the non-magnetic isolator positioned in the cleaning section and attached to the housing, the non-magnetic isolator surrounding and sealing the driven magnetic roller wherein the non-magnetic isolator includes a curved body having an upper angled portion coupled to a lower tapered portion by a curved surface that accommodates the driven magnetic roller, the upper angled portion angled such that it has a steeper angle than an angle of repose of an incoming product;

wherein the driven magnetic roller is positioned proximate the inner surface of the non-magnetic isolator and the magnetic roller includes a magnetic field that penetrates a flow of product contacting the non-magnetic isolator wherein ferrous particles travel along the outer surface of the isolator and non-ferrous particles do not travel on the outer surface separating the ferrous and non-ferrous particles without contact of the product with the driven magnetic roller.

14. The magnetic separator of claim 13 wherein the magnetic roller includes a magnetic differential defined by a dead zone of magnets having a lower magnetic field.

15. The magnetic separator of claim 13 wherein the entry section includes a baffle positioned therein, the baffle controlling an angle of entry of the product wherein the angle of entry is from zero to 45 degrees as measured from a vertical plane.

16. The magnetic separator of claim 13 wherein the outer surface of the non-magnetic isolator includes a frictional coefficient selected to slow movement of the ferrous particles on the outer surface.

17. The magnetic separator of claim 13 wherein the outer surface of the non-magnetic isolator includes a frictional coefficient selected to promote movement of the ferrous particles on the outer surface.

18. A magnetic separator for a product having ferrous and non-ferrous particles comprising:

a housing including an entry section and a cleaning section wherein the entry section includes a baffle positioned therein, the baffle controlling an angle of entry of the product wherein the angle of entry is from zero to 45 degrees as measured from a vertical plane;

a driven magnetic roller disposed within the cleaning section;

a non-magnetic isolator including inner and outer surfaces, the non-magnetic isolator positioned in the cleaning section and attached to the housing, the non-magnetic isolator surrounding and sealing the driven magnetic roller;

wherein the driven magnetic roller is positioned proximate the inner surface of the non-magnetic isolator and the magnetic roller includes a magnetic field that penetrates a flow of product contacting the non-magnetic isolator wherein ferrous particles travel along the outer surface of the isolator and non-ferrous particles do not travel on the outer surface separating the ferrous and non-ferrous particles without contact of the product with the driven magnetic roller.

* * * * *